United States Patent [19]

Deckard et al.

[11] Patent Number: 4,568,021

[45] Date of Patent: Feb. 4, 1986

[54] ELECTROMAGNETIC UNIT FUEL INJECTOR

[75] Inventors: John I. Deckard, Grand Rapids; Richard F. Teerman, Wyoming; Russell H. Bosch, Grandville, all of Mich.

[73] Assignee: General Motors Corporation, Detroit, Mich.

[21] Appl. No.: 595,694

[22] Filed: Apr. 2, 1984

[51] Int. Cl.[4] ..... F02M 51/00

[52] U.S. Cl. ..... 239/88; 239/585

[58] Field of Search ..... 239/88–95, 239/124, 585

[56] References Cited

U.S. PATENT DOCUMENTS

| | | | |
|---|---|---|---|
| 3,606,158 | 11/1969 | Pritchard | 239/124 |
| 4,373,671 | 2/1983 | Giardini | 239/585 |
| 4,408,718 | 11/1983 | Wich | 239/88 |

FOREIGN PATENT DOCUMENTS

| | | | |
|---|---|---|---|
| 1239627 | 7/1960 | France | 239/88 |

*Primary Examiner*—Jeffrey V. Nase
*Assistant Examiner*—Mary Beth O. Jones
*Attorney, Agent, or Firm*—Arthur N. Krein

[57] ABSTRACT

An electromagnetic unit fuel injector for use in a diesel engine includes a housing with a pump therein defined by an externally actuated plunger reciprocable in a bushing and defining therewith a pump chamber open at one end for the discharge of fuel to a spring biased, pressure actuated fuel injection nozzle. The pump chamber is also connected to a supply/spill chamber via a normally open, hollow, ported valve controlled passage to permit the ingress and egress of fuel, the valve being operated by a solenoid. The stator assembly of the solenoid is fixed to the housing over the supply/spill chamber and has a cover fixed thereto to define an armature chamber for a moveable armature. The solenoid pole piece has a stepped bore therethrough to interconnect the armature chamber and the supply/spill chamber. The armature is operatively connected to the valve by a guide pin slidably and sealingly journaled in a non-magnetic bushing fixed in the stepped bore so that the armature chamber remains dry.

3 Claims, 7 Drawing Figures

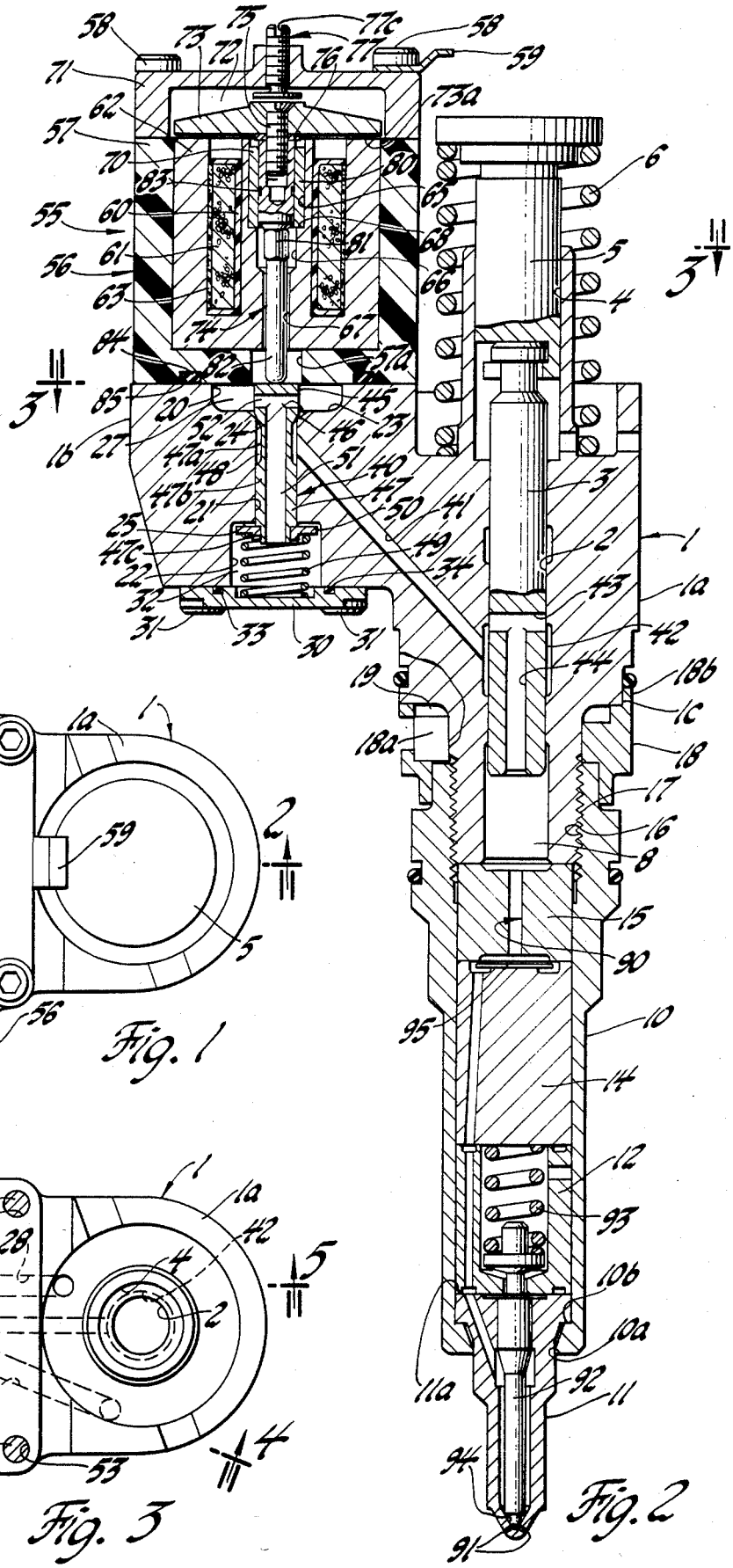
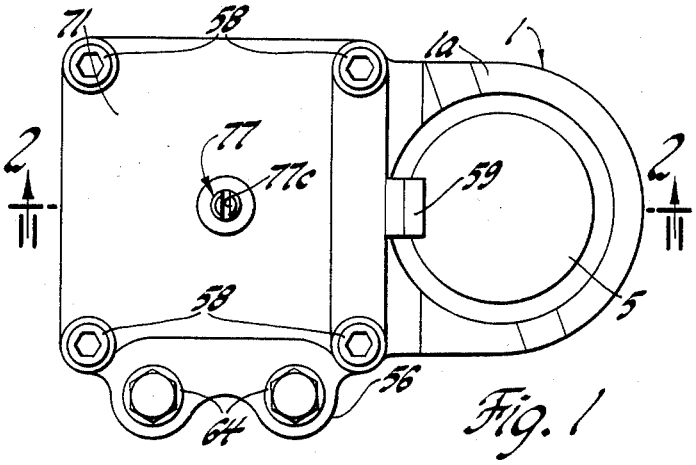
Fig. 1
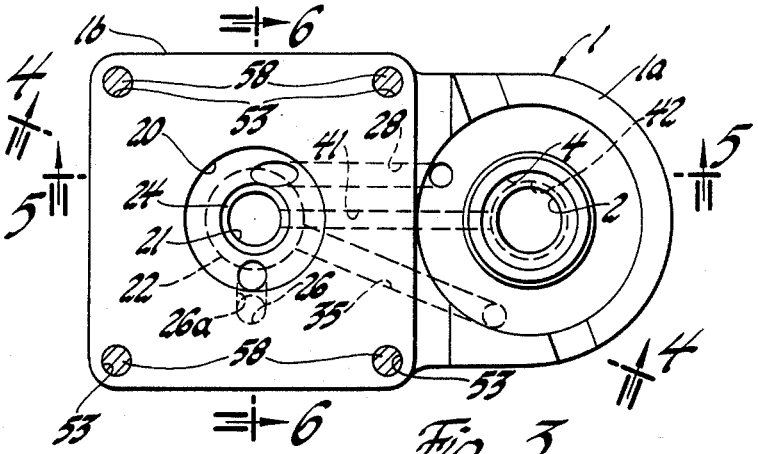
Fig. 3
Fig. 2

ELECTROMAGNETIC UNIT FUEL INJECTOR

This invention relates to unit fuel injectors of the type used to inject fuel into the cylinders of a diesel engine and, in particular, to an electromagnetic unit fuel injector having a push type, dry solenoid controlled valve therein to control the spill-inject-spill operation of the unit.

DESCRIPTION OF THE PRIOR ART

Unit fuel injectors, of the so-called jerk type, are commonly used to pressure inject liquid fuel into an associate cylinder of a diesel engine. As is well known, such a unit injector includes a pump in the form of a plunger and bushing which is actuated, for example, by an engine driven cam whereby to pressurize fuel to a suitable high pressure so as to effect the unseating of a pressure actuated injection valve in the fuel injection nozzle incorporated into the unit injector.

In one form of such a unit injector, the plunger is provided with helices which cooperate with suitable ports in the bushing whereby to control the pressurization and therefore the injection of fuel during a pump stroke of the plunger.

In another form of such a unit injector, a solenoid valve is incorporated in the unit injector so as to control, for example, the drainage of fuel from the pump chamber of the unit injector. In this latter type injector, fuel injection is controlled by the energization of the solenoid valve, as desired, during a pump stroke of the plunger whereby to terminate drain flow so as to permit the plunger to then intensify the pressure of fuel to effect unseating of the injection valve of the associated fuel injection nozzle.

Exemplary embodiments of such electromagnetic unit fuel injectors are disclosed, for example, in U.S. Pat. No. 4,129,253 entitled Electromagnetic Unit Fuel Injector issued Dec. 12, 1978 to Ernest Bader, Jr., John I. Deckard and Dan B. Kuiper and in U.S. Pat. No. 4,392,612 entitled Electromagnetic Unit Fuel Injector issued July 12, 1983, in the names of John I. Deckard and Robert D. Straub.

In all such known electromagnetic unit injectors, which may also be referred to as electronic unit injectors, the armature of the solenoid assembly, used to actuate the control valve, have operated in an associate armature chamber containing fuel, such as diesel oil. Thus the armature operated in a chamber containing hydraulic fluid and thus movement of the armature was opposed by this fluid, which of course had to be displaced from one side of the armature to the opposite side during armature movement. In addition, a minimum fixed air gap had to be maintained between the opposed working surfaces of the armature and associate pole piece in all such injectors in order to prevent hydraulic stiction.

SUMMARY OF THE INVENTION

The present invention provides an electromagnetic unit fuel injector that includes a pump assembly having a plunger reciprocable in a bushing and operated, for example, by an engine driven cam, with flow from the pump during a pump stroke of the plunger being directed to a fuel injection nozzle assembly of the unit that contains a spring biased, pressure actuated injection valve therein for controlling flow out through the spray tip outlets of the injection nozzles. During the pump stroke, spill flow from the pump can also flow through a passage means, containing a normally open, solenoid actuated control valve means to a fuel supply chamber. Fuel injection is regulated by the controlled energization of the solenoid actuated valve means during a pump stroke of the plunger to permit pressure intensification of fuel to a value to effect unseating of the injection valve whereby to effect fuel injection. Upon deenergization of the solenoid, injection is terminated and spill flow will again occur. Thus the term spill-inject-spill. The solenoid actuator arrangement is such that the armature thereof operates in a dry armature chamber.

It is therefore a primary object of this invention to provide an improved electromagnetic unit fuel injector that contains a push type, dry solenoid used to actuate a control valve means controlling the spill-inject-spill cycles during each pump stroke of the plunger.

Another object of the invention is to provide an improved electromagnetic unit fuel injector having a push type solenoid used to effect operation of a valve, the solenoid structure being arranged so that the armature thereof operates in a dry armature chamber to permit drag free movement of the armature.

Still another object of the invention is to provide an improved electromagnetic unit fuel injector with a push-type electromagnetic assembly with dry armature cavity for fast response and control, in cooperation with an inverted poppet type control valve, to provide pilot injection capability and fast fuel injection termination to lessen the engine noise level and smoke, common to diesel direct injection engines.

For a better understanding of the invention, as well as other objects and further features thereof, reference is had to the following detailed description of the invention to be read in connection with the accompanying drawings.

DESCRIPTION OF THE DRAWINGS

FIG. 1 is a plan view of an electromagnetic unit fuel injector in accordance with the invention;

FIG. 2 is a longitudinal sectional view of the electromagnetic unit fuel injector taken along line 2—2 of FIG. 1, the pump plunger being shown at the start of a pump stroke and the control valve being shown in its valve closed position;

FIG. 3 is a plan view of the injector body, per se, of the injector taken as along line 3—3 of FIG. 2;

DESCRIPTION OF THE PREFERRED EMBODIMENT

Figure 4:
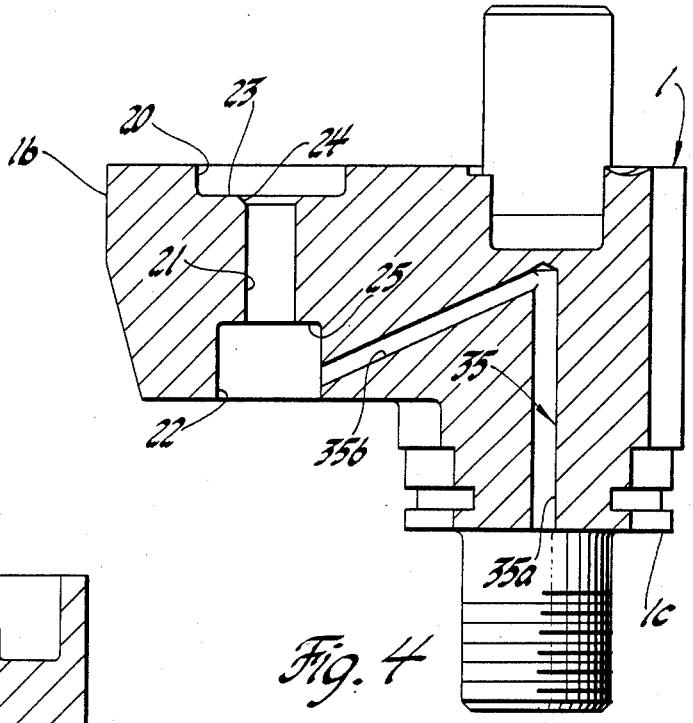
FIGS. 4, 5 and 6 are cross-sectional views of the injector body, per se, taken along lines 4—4, 5—5 and 6—6, respectively of FIG. 3; and, FIG. 7 is an enlarged sectional view of a portion of the solenoid and push rod of the injector shown in FIG. 2.

Referring now to the drawings and, in particular, to FIG. 1, there is shown an electromagnetic unit fuel injector constructed in accordance with the invention, that is, in effect, a unit fuel injector-pump assembly with a dry electromagnetic push actuated valve incorporated therein to control fuel discharged from the injector portion of this assembly in a manner to be described.

In the construction illustrated, the electromagnetic unit fuel injector includes an injector body 1 which includes a vertical main body portion 1*a* and a side body portion 1*b*. The body portion 1*a* is provided with a stepped bore therethrough defining a cylindrical lower wall or bushing 2 of an internal diameter to slidably receive a pump plunger 3 and an upper wall 4 of a larger internal diameter to slidably receive a plunger actuator follower 5. The follower 5 extends out one end of the body 1 whereby it and the plunger connected thereto are adapted to be reciprocated by an engine driven cam or rocker, in the manner well known in the art, and by a plunger return spring 6 in a conventional manner.

The pump plunger 3 forms with the bushing 2 a pump chamber 8 at the lower open end of the bushing 2, as shown in FIG. 2.

Forming an extension of and threaded to the lower end of the body 1 is a nut 10. Nut 10 has an opening 10*a* at its lower end through which extends the lower end of a combined injector valve body or spray tip 11, hereinafter referred to as the spray tip, of a conventional fuel injection nozzle assembly. As shown, the spray tip 11 is enlarged at its upper end to provide a shoulder 11*a* which seats on an internal shoulder 10*b* provided by the through counterbore in nut 10. Between the spray tip 11 and the lower end of the injector body 1 there is positioned, in sequence starting from the spray tip, a rate spring cage 12, a spring retainer 14 and director cage 15 clamped and stacked end-to-end between the upper face 11*a* of the spray tip and the bottom face of body 1. All of these above-described elements have lapped mating surfaces whereby they are held in pressure sealed relation to each other.

In the embodiment illustrated, the electromagnetic unit injector is adapted to be mounted in the cylinder head of an engine, not shown, of the type having a suitable supply/drain passage or fuel rail, not shown, formed in the cylinder head whereby fuel, as from a fuel tank via a supply pump and conduit can be supplied at a predetermined relative low supply pressure to the injector and whereby fuel can be drained back to a correspondingly low pressure fuel area.

Accordingly, in the construction shown and as best seen in FIG. 2, a suitable filter ring 18 with a plurality of circumferentially spaced apart screened apertures 18*a* therethrough is positioned so as to encircle the lower reduced diameter end of the main body portion 1*a*. As shown, the filter ring 18 is thus sandwiched between a shoulder 1*c* of this body portion 1*a* and the upper end surface of the nut 10. In the construction illustrated, the filter ring 18 is provided with one or more upright tabs 18*b* which extend into correspondingly sized vertical slots 1*c* provided for this purpose on the exterior of the main body portion 1*a* to effect angular orientation of the filter, only one such tab and slot being shown in FIG. 2. The interior of the filter ring 18 as thus located defines, with the main body portion 1*a*, a fuel chamber 19.

Figure 6:
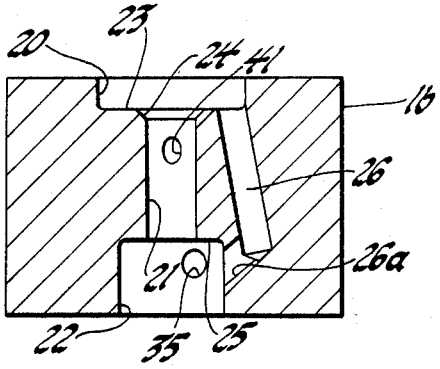

Referring now to the side body portion 1*a* of the injector body 1, it is provided with a stepped vertical bore therethrough which defines a circular, internal upper wall 20, an intermediate or valve stem guide wall 21 and a lower wall 22. Walls 20 and 22 are both of larger internal diameters than the internal diameter of guide wall 21. Wall 20 is connected to wall 21 by flat shoulder 23 and by an annular conical valve seat 24, the latter encircling guide wall 21. Walls 21 and 22 are interconnected by a flat shoulder 25. A pair of angled passages 26 and 26*a*, as best seen in FIGS. 3 and 6, extending from shoulder 23 through lower wall 22 defines a pressure equalizing passage 26 for a purpose to be described in detail hereinafter.

As shown in FIG. 2, the solenoid casing 50, of a solenoid assembly 55 to be described in detail hereinafter, with a central aperture therethrough is suitably secured as by screws to the upper surface of the side body portion 1*a* with the axis of this aperture aligned with that of the bore defining the valve stem guide wall 21. The lower face of this solenoid casing retainer defines a supply/spill chamber 27 with the upper bore wall 20 and shoulder 23.

Figure 5:
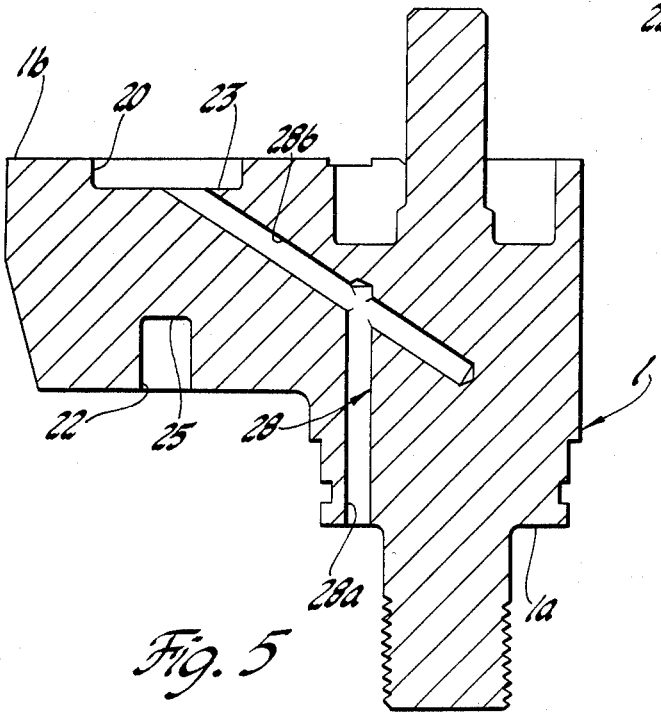

The supply/spill chamber 27 is in flow communication with the fuel chamber 19 by means of a supply passage 28, which in the construction shown and as best seen in FIG. 5, includes a bore 28*a* that extends upward from the shoulder 1*c* on the main body portion 1*a* so as to intesect a bore 28*b* that is inclined so as to extend up through the side body portion 18 to break through the shoulder 23 into the cavity defining the supply/spill chamber 27.

As shown in FIG. 2, a closure cap 30 suitably secured, as by screws 31, against the flat bottom or lower surface 1*c* of the side body defines with the lower wall 22 and shoulder 25, a spring/drain chamber 32. An O-ring seal 33 positioned in an annular groove 34 provided for this purpose in the closure cap 28 effects a seal between this closure cap and the flat surface 1*c*.

The spring/drain chamber 32 is in flow communication with the fuel chamber 19 by means of a drain passage 35, which in the construction shown and as best seen in FIG. 4, includes a bore 35*a* that extends axially upward from the shoulder 1*c* to intersect a downwardly inclined bore 35*b* which at its lower end opens through lower wall 22 into the cavity defining the spring/drain chamber 32.

The ingress and egress flow of fuel between the supply/spill chamber 27 and the pump chamber 8 is controlled by means of a control or poppet valve 40 actuated by means of a push-type solenoid, generally designated 55, constructed in accordance with a feature of the invention to be described in detail hereinafter.

The actual ingress and egress of fuel to and from the pump chamber 8 is effected by a passage means which includes an inclined passage 41 provided in the injector body 1 so that its lower end opens into an annular chamber defined by a groove 42 provided in bushing 2 while its upper end opens through the valve stem guide wall 21 at a location next adjacent to the valve seat 24. Flow communication between the passage 41 via groove 42 and the pump chamber 8 is by means of at least one radial passage 43 and an interconnecting axial pasage 44 formed in the lower end of the plunger 3. As shown in FIG. 2, the axial extent of groove 42 is such that the radial passage will be in flow communication therewith during the full operational reciprocation of the plunger 3.

Fuel flow between the supply/spill chamber 27 and passage 41 is controlled by means of control valve 40, in the form of a hollow poppet valve. The valve 40 includes a head 45 with a conical valve seat surface 46 thereon, and a stem 47 extending downward therefrom with reference to FIG. 2. The stem 47 including a first stem portion 47*a* of reduced diameter next adjacent to the head 45 and of an axial extent so as to form with the guide wall 21 and annulus cavity 48 that is always in fuel communication with the passage 41 during opening and closing movement of the poppet valve, a guide stem portion 47*b* of a diameter to be slidably guided in the valve stem guide wall 21, a lower reduced diameter portion 47*c*. The valve 40 is normally biased in a valve opening direction, upward with reference to FIG. 2, by means of a coil spring 49 loosely encircling the portion 47*c* of the valve stem 47. As shown, one end of the spring 49 abuts against a washer-like spring retainer 50 encircling stem portion 47*c* so as to abut against a shoulder thereon. The other end of spring 49 abuts against the lower recessed face of the cap 30.

In addition, the head 45 and stem 47 of the valve 40 are provided with a stepped blind bore so as to materially reduce the weight of this valve and so as to define a pressure relief passage 51 of a suitable axial extent whereby at its upper end it can be placed in fluid communication via radial ports 52 with the supply/spill chamber 27.

The control valve 40 in the construction shown, is a pressure balanced type poppet valve. That is, the angle of the valve seat surface 46 on the head of the valve 40 and the angle of the valve seat 24 are preselected relative to each other so that the valve seat surface 46 engages the valve seat 24 at its connecting edge with the valve stem guide wall 21. Accordingly, when the control valve 40 is in a closed position, high pressure fuel in the annular cavity 48 will act against opposed surfaces of equal area in the valve. With this arrangement, minimum force will then be required to hold the control valve 40 closed against the preselected force of the valve return spring 49.

It will be appreciated, however, by those skilled in the art, that an unbalanced pressure poppet valve, of the type similar to that shown, but wherein the actual diameter of the valve seat surface 46 in line contact with the valve seat 24, when the control valve is in a closed position, is a predetermined amount greater than the internal diameter of the valve stem guide wall 21, could be used in lieu of the pressure balanced control valve 40, if desired for certain engine applications.

Movement of the valve 40 is controlled by means of a push-type solenoid assembly 55 which, in accordance with a feature of the invention, has the armature 73 thereof operable in a dry armature chamber 72, both to be described in detail hereinafter, thus eliminating the hydraulic response effect common in prior known electromagnetic unit injectors.

In the embodiment shown, the solenoid assembly 55 includes a stator assembly 56 having an cup-shaped solenoid case 57, made, for example, of a suitable plastic which is secured by screws 58 in a manner to be described hereinafter to the upper machined flat surface of the side body portion 1*b* in position so that the aperture 57*a* in the base thereof is substantially coaxial with the axis of the bore defining the valve stem guide wall 21, as best seen in FIGS. 2 and 3.

A rectangular coil bobbin 60, supporting a wound solenoid coil 61 and a lamenated E-shaped stator or pole piece 62 and a wound paper insulator 63 encircling the coil 61 are supported within the solenoid case 57. The ends of the solenoid coil 61 are connected to a pair of terminals 64 supported in a side extension of the solenoid case 57, whereby the coil 61 is adapted to be connected by electrical conductors, not shown, to a suitable source of electrical power via a fuel injection electronic control circuit, not shown, so that the solenoid coil 61 can be energized as a function of the operating conditions of an engine in a manner well known in the art.

In the construction shown, the solenoid case 57 was molded so as to encapsulate the coil bobbin 60, solenoid coil 61, pole piece 62, insulator 63 and the terminals 64 sub-assembly.

As best seen in FIG. 2, the pole piece 62 is provided with a stepped bore extending through the central leg and base thereof and coaxial with aperture 57*a* to define a circular internal upper bushing wall 65, an intermediate wall 66 and a lower wall 67, with the walls 66 and 67 being of progressively reduced internal diameters relative to bushing wall 65. Walls 65 and 66, in the construction shown, are interconnected by a flat shoulder 68.

A guide bushing 70, made for example of a suitable non-magnetic material, such as stainless steel or a ceramic material is secured as by a suitable adhesive material, such as an epoxy cement, (not shown) in the pole piece 62 so as to be encircled by the bushing wall 65 and with its lower end in abutment against the shoulder 68.

A solenoid cover or cap 71, of inverted cup-shape and made of a non-magnetic material, such as stainless steel, is fixed, as by the screws 58 to the upper surface of the solenoid case 57 to form therewith and with the upper end working surface of the pole piece 62 the armature chamber 72. In the construction illustrated, each of the screws 58 extends through suitable aligned apertures provided for this purpose in the solenoid cap 71 and in the solenoid case 57 for threaded engagement in an associate internally threaded aperture 53 provided in the side body portion 1*b*. Also as best seen in FIGS. 1 and 2, a pair of the screws 58 are also used to retain a plunger stop 59 used to retain the follower 5 and plunger 3 in unit assembly with the injector body 1 when the electromagnetic unit injector assembly is not operatively installed in an engine, not shown.

An armature 73, having a flat working surface 73*a* on one side thereof, is operatively positioned in the armature chamber 72 and is operatively connected to the valve 40 by means of a push rod or guide pin 74 which is fixed to the armature 73 by means of a flat headed screw 75 which extends through a countersunk aperture 73*b* in the armature 73 for threaded engagement in the internally threaded aperture 74*a* in the enlarged upper end of the guide pin 74.

Figure 7:
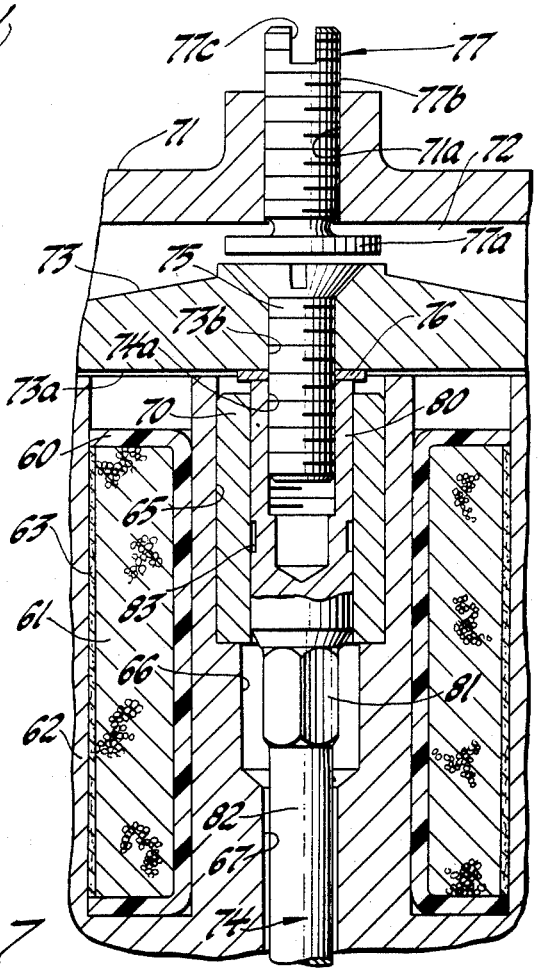

In the construction shown, a spacer shim washer 76, of predetermined thickness as desired, is sandwiched between the armature 73 and the upper end of the armature whereby to provide a fixed minimum air gap between the opposed working surfaces of the armature 73 and pole piece 62 when the valve 40 is seated against valve seat 24, the position shown in FIGS. 2 and 7.

Upward movement of the armature 73, with reference to FIGS. 2 and 7, and thus opening movement of the valve 40 is controlled by means of a flat headed screw 77 adjustably threaded in a central internally threaded bore 71*a* provided in cap 71. As shown, the flat head 77*a* of the stop screw 77 is positioned in the armature chamber 72 while the stem 77*b* of the stop screw 77 extends outboard of the central boss of the cap 71 and is provided with a screwdriver receiving slot 77*c*.

In a particular application, the shim washer 76 was selected (graded) to provide for a 0.103 to 0.113 mm minimum fixed air gap between opposed working surface of the armature 73 and pole piece 62 with the control valve 40 in a closed position, the position shown in FIGS. 2 and 7. In this same application, the stop screw 77 was axially positioned in the cap 71 to permit upward movement of the armature 73 and thus an opening stroke of the control valve a distance of 0.103 to 0.113 mm, thus, in effect, providing a working air gap of 0.206 to 0.226 mm between the opposed working surfaces of the armature 73 and pole piece 62 when the control valve 40 is in its raised or full open position relative to valve seat 24.

In accordance with a feature of the invention, the guide pin 74 is provided with an upper enlarged diameter sealing land portion 80, an intermediate portion 81 having flats thereon, such as a hex, which is adapted to be engaged by a suitable tool, not shown, during attachment of this guide pin to the armature 73 and a lower reduced diameter portion 82 that loosely extends through lower wall 67 of the pole piece 62 and through the aperture 57*a* in solenoid case 57 into abutment with the head 45 of valve 40.

As shown, the sealing land portion 80 is provided with one or more annular grooves 83, only one such groove being used in the construction shown, so as to define a labyrinth seal and the outside diameter of the sealing land portion 80 is selected relative to the internal bore diameter of an associate guide bushing 70 so as to slidably and sealingly fit therein with a clearnce of, for example, from 0.0015 to 0.0023 mm.

With this arrangement, the sealing land portion 80 of the guide pin 74 Cforms with the guide bore of the guide bushing 70 a sliding seal which prevents fuel flow from the supply/spill chamber upward into the armature chamber 72. Thus during operation of the subject electromagnetic fuel injector, the armature chamber 72 will remain dry so that there will be no hydraulic damping of the armature 73 during movement thereof between the control valve open and closed positions.

As illustrated in FIG. 2, a suitable O-ring seal 84 positioned in a suitable annular groove 85 provided, for example, in the solenoid case 57 is used to effect a seal between this solenoid case and the upper surface of the side body portion 1*b* radially outward of the supply/-spill chamber 27.

During a pump stroke of the plunger 3, fuel is adapted to discharged from the pump chamber 8 into the inlet end of a discharge passage means 90 provided in the director cage 15, spring retainer 14, rate spring cage 12 and spray tip 11 elements of the fuel injection nozzle assembly which is of a conventional type and is similar to that used in the electromagnetic unit fuel injector disclosed in the above-identified U.S. Pat. No. 4,392,612. The discharge passage means 90 at its opposite end communicates with one or more discharge orifices 91 in the lower end of the spray tip, with flow to theses discharge orifices 91 controlled by a needle valve 92 that is normally biased by a spring 93 into engagement with an annular valve seat 94 located upstream of the discharge orifices. Also, as is conventional, a disc check valve 95 is operatively positioned in the discharge passage means 90 to retain fuel in this passage means downstream of this valve during a suction stroke of the pump plunger 3.

FUNCTIONAL DESCRIPTION

Referring now in particular to FIG. 2, during engine operation, fuel would be supplied at a predetemined supply pressure by a pump, not shown, to the subject electromagnetic unit fuel injector through a supply/-drain passage provided in the engine cylinder head, both not shown, with fuel then flowing through the filter ring 18 into the fuel chamber 19. Fuel thus admitted can then flow through the associated passages into the supply/spill chamber 27 and into the spring/drain chamber 32.

With the solenoid coil 61 of the solenoid assembly 55 deenergized, the valve spring 49 is operative to open and hold open the control valve 40 relative to its valve seat 24. At the same time, the armature 73 is also in a raised position relative to the pole piece 72, by means of its guide pin 74 connection the control valve 40, whereby a predetermined working air gap exists between the opposed working surfaces of the armature and pole piece.

Thus during a suction stroke of the pump plunger 3, with the control valve 40 then in its open position, fuel can flow from the supply/spill chamber 27 through the now uncovered annulus cavity 48 into passage 42 and from this passage 1 via groove 42 and passages 43 and 44 into the pump chamber 8. At the same time, fuel will also be present in the discharge passage means 90 of the injector nozzle assembly.

Thereafter, as the follower 5 is driven downward, as by a rocker arm, not shown, to effect a pump stroke of the pump plunger 3, this downward movement of the plunger 3 with reference to FIG. 2 will cause pressurization of the fuel within the pump chamber 8 and of course of the fuel in the passages in flow communication with this pump chamber. However, with the solenoid coil 61 still deenergized, this pressure can only rise to a level that is a predetermined amount less than the "pop" pressure required to lift the needle valve 92 against the force of its associate return spring 93, since during this period of time, the fuel displaced from the pump chamber 8 can flow back to the supply/spill chamber 27 since the control valve 40 is still in an open position.

Thereafter, during the continued downward movement of the pump plunger 3 on the pump stroke, an electrical (current) pulse of finite character and duration (timed, for example, relative to the top dead center of the associate engine piston position, not shown) applied through suitable electrical conductors to the solenoid coil 61 produces an electromagnetic field attracting the armature 73 downward toward the pole piece 62, that is, to the position shown in FIGS. 2 and 7. This movement of the armature 73, as coupled to the control valve 40 by means of the guide pin 74, will effect seating of the control valve 40. As this occurs, the drainage of fuel from the pump chamber 8 back to the supply/spill chamber 27 will no longer occur. Without this spill of fuel from the pump chamber 8, the continued downward movement of the pump plunger 3 will rapidly increase the pressure of fuel therein to the "pop" pressure level to effect unseating of the needle valve 92. This then permits the injection of fuel out through the discharge orifices 91. Normally, the injection pressure continues to build up during further continued downward movement of the pump plunger 3.

Ending the application of the electrical current pulse to the solenoid coil 61 causes the electromagnetic field to collapse. As this occurs, the valve spring 49 is then operative to effect unseating of the control valve 40 so as to then allow spill flow of fuel from the pump chamber 8 via passages 44, 43, groove 42, passage 41 and annulus cavity 48 back to the supply/spill chamber 27. This spill flow of fuel thus releases the injection nozzle system pressure in the discharge passage means 90 so that the spring 93 can again effect seating of the needle valve 92. Of course, as the control valve 40 is opened, the armature 73, via its guide pin 74 connection with the control valve 40, will again be moved to its deenergized position.

During this spill flow of pressurized fuel into the supply/spill chamber 27, there will not be any rapid increase of fuel pressure in this chamber, since the quantity of this spilled fuel will be relatively small and since this supply/spill chamber 27 is in direct flow communication with the spring/drain chamber 32 via the previously described passages provided in both the control valve 40 and in the side body portion 1*b*, with these chambers 27 and 32 also being in direct flow communication with fuel chamber 19 via their associate passages 28 and 35, respectively.

It should now be realized that although the passages 28 and 35 have been identified herein as being a supply passage and a drain passage, respectively, these terms have been used for general descriptive purposes only. Thus it should be apparent to those skilled in the art, that since both the supply passage 28 and the drain passage 35, in the construction shown, are connected to a common fuel chamber 19 through which fuel is both supplied and drained from the subject injector assembly and since the supply/spill chamber 27 and the spring/-drain chamber 32 are in direct flow communication in the manner previously described, during a suction stroke of the pump plunger 3 fuel at any instant be supplied to the supply/spill chamber 27 for flow to the pump chamber 8 via either or both of passages 28 and 35. Of course during a pump stroke of the pump plunger 3 while the control valve 40 is unseated, drain flow of fuel back to the fuel chamber can occur through either or both of these passages 28 and 35.

While the invention has been described with reference to the embodiment disclosed herein, it is not confined to the details set forth since it is apparent that various modification can be made by those skilled in the art without departing from the scope of the invention. For example, instead of the single fuel chamber 19 serving both as a supply chamber and a drain chamber, two such chambers could be provided, one serving as a fuel supply chamber in flow communication with a supply conduit and the other as a drain chamber in flow communication with a drain conduit in a manner well known in the art. Also, instead of the bushing/push rod clearance sealing arrangement, an alternate seal arrangement, such as, for example, a flexible diaphragm seal, not shown, with a press fit on the push rod, can be used to isolate fuel from the solenoid armature chamber. This application is therefore intended to cover such modifications or changes as may come within the purposes of the invention as defined by the following claims.

The embodiments of the invention in which an exclusive property or privilege is claimed are defined as follows:

1. In an electromagnetic unit fuel injector of the type having a housing means with a pump cylinder means therein; an externally actuated plunger reciprocable in said cylinder means to define therewith a pump chamber; a valve controlled injection nozzle means connected to the housing means in flow communication with the pump chamber; the housing means further including a supply/spill chamber means and a spring/-drain chamber means in axial spaced apart relationship to each other with a valve stem guide bore extending therebetween and with a conical valve seat encircling the guide bore at the supply/spill chamber means end thereof; a supply/drain passage means in flow communication at one end with the supply/spill chamber means and being connectable at its other end to a source of fuel at a predetermined supply pressure; a passage means in said housing means in flow communication at one end with the pump chamber and at its other end with the guide bore next adjacent to the valve seat; a hollow ported poppet valve means having a stepped stem slidably received in the guide bore and a head loosely received in the supply/spill chamber means for controlling flow between the supply/spill chamber means and the passage means; a spring means operatively positioned to normally bias the valve means to effect flow communication between the supply/spill chamber means and said passage means; and, a push-type solenoid means operatively supported in said housing means; the improvement wherein said solenoid means includes a stator means operatively fixed at one end to the housing means to partly enclose one end of the supply/spill chamber means, a cup-shaped cover fixed to the opposite end of said stator means to define therewith an armature chamber, an armature operatively located in said armature chamber, said stator means having a stepped bore therethrough defining a bushing wall next adjacent said armature chamber and a wall means of an internal diameter less than that of said bushing wall, a nonmagnetic bushing sealingly positioned in said bushing wall and, a guide pin reciprocable and sealingly journaled in said bushing, said guide pin having one end thereof operatively connected to said armature, the opposite end of said guide pin extending into said supply/spill chamber so as to abut against said valve means whereby, upon energization of said solenoid means, said armature will be operative to push said valve means in an axial direction to block flow communication between the supply/spill chamber and the passage means.

2. In an electromagnetic unit fuel injector of the type having a housing means with a pump cylinder means therein; an externally actuated plunger reciprocable in said cylinder means to define therewith a pump chamber; a valve controlled injection nozzle means connected to the housing means in flow communication with the pump chamber; the housing means further including a supply/spill chamber means and a spring/-drain chamber means in axial spaced apart relationship to each other with a valve stem guide bore extending therebetween and with a conical valve seat encircling the guide bore at the supply/spill chamber means end thereof; a supply/drain passage means in flow communication at one end with the supply/spill chamber means and being connectable at its other end to a source of fuel at a predetermined supply pressure; a passage means in said housing means in flow communication at one end with the pump chamber and at its other end with the guide bore next adjacent to the valve seat; a hollow ported poppet valve means having a stepped stem slidably received in the guide bore and a head loosely received in the supply/spill chamber means for controlling flow between the supply/spill chamber means and the passage means; a spring means operatively positioned in the spring/drain chamber to normally bias the valve means to effect flow communication between the supply/spill chamber means and said passage means; and, a push-type solenoid means operatively supported in said housing means; the improvement wherein said solenoid means includes a stator means having an E-shaped pole piece operatively fixed at one end to the housing means to partly enclose one end of the supply/spill chamber means, a cup-shaped cover operatively fixed to the opposite end of said stator means to define therewith an armature chamber, an armature operatively located in said armature chamber for movement relative to said pole piece, said pole piece having a stepped bore therethrough defining a bushing wall next adjacent said armature chamber and wall means of internal diameter less than that of said bushing wall, a nonmagnetic bushing sealingly positioned in said bushing wall and, a guide pin reciprocable in said stepped bore with one end thereof operatively connected to said armature and having its opposite end extending into said supply/spill chamber so as to abut against said valve means, said guide pin including a sealing land portion sealingly journaled in said bushing to effect a fluid seal between the supply/spill chamber means and said armature chamber whereby said armature is operative in a dry armature chamber.

3. In an electromagnetic unit fuel injector of the type having a housing means with a pump cylinder means therein; an externally actuated plunger reciprocable in said cylinder means to define therewith a pump chamber; a valve controlled injection nozzle means connected to the housing means in flow communication with the pump chamber; the housing means further including a supply/spill chamber means and a spring/-drain chamber means in axial spaced apart relationship to each other with a valve stem guide bore extending therebetween and with a conical valve seat encircling the guide bore at the supply/spill chamber means end thereof; a supply/drain passage means in flow communication at one end with the supply/spill chamber means and being connectable at its other end to a source of fuel at a predetermined supply pressure; a passage means in said housing means in flow communication at one end with the pump chamber and at its other end with the guide bore next adjacent to the valve seat; a hollow ported poppet valve means having a stepped stem slidably received in the guide bore and a head loosely received in the supply/spill chamber means for controlling flow between the supply/spill chamber means and the passage means; a spring means operatively positioned to normally bias the valve means to effect flow communication between the supply/spill chamber means and said passage means; and, a push-type solenoid means operatively supported in said housing means; the improvement wherein said solenoid means includes a stator means operatively fixed at one end to the housing means to partly enclose one end of the supply/spill chamber means, a cup-shaped cover fixed to the opposite end of said stator means to define therewith an armature chamber, an armature operatively located in said armature chamber, said stator means having a bore therethrough, a guide pin reciprocably journaled in said stator means, and a nonmagnetic seal means operatively and sealingly associated with said stator means and said guide pin to prevent fuel flow from said supply/spill chamber to said armature chamber; said guide pin having one end thereof operatively connected to said armature, the opposite end of said guide pin extending into said supply/spill chamber so as to abut against said valve means whereby, upon enerization of said solenoid means, said armature will be operative to push said valve means in an axial direction to block flow communication between the supply/spill chamber and the passage means.

* * * * *